US009702250B2

(12) United States Patent
Szpek, Jr. et al.

(10) Patent No.: US 9,702,250 B2
(45) Date of Patent: Jul. 11, 2017

(54) POWER SHOVEL HOIST MACHINERY WITH AUXILIARY WEIGHT BOX

(71) Applicant: Caterpillar Global Mining LLC., Oak Creek, WI (US)

(72) Inventors: Frank R. Szpek, Jr., Franklin, WI (US); Carl D. Gilmore, So. Milwaukee, WI (US); David T. Bienfang, Mukwonago, WI (US)

( * ) Notice: Subject to any disclaimer, the term of this patent is extended or adjusted under 35 U.S.C. 154(b) by 0 days.

(21) Appl. No.: 14/791,303

(22) Filed: Jul. 3, 2015

(65) Prior Publication Data

US 2015/0308266 A1 Oct. 29, 2015

Related U.S. Application Data

(62) Division of application No. 13/757,059, filed on Feb. 1, 2013, now Pat. No. 9,127,435.

(51) Int. Cl.

| | |
|---|---|
| ***E02F 3/46*** | (2006.01) |
| ***E21C 27/30*** | (2006.01) |
| ***E02F 9/18*** | (2006.01) |
| ***E02F 9/22*** | (2006.01) |
| ***E02F 9/08*** | (2006.01) |
| ***B66F 9/075*** | (2006.01) |
| ***E02F 9/20*** | (2006.01) |
| ***E02F 3/30*** | (2006.01) |

(52) U.S. Cl.

CPC ..... *E21C 27/30* (2013.01); *B66F 9/07595* (2013.01); *E02F 3/304* (2013.01); *E02F 3/308* (2013.01); *E02F 3/46* (2013.01); *E02F 9/0866* (2013.01); *E02F 9/18* (2013.01); *E02F 9/2016* (2013.01); *E02F 9/226* (2013.01)

(58) Field of Classification Search

CPC . E02F 9/0866; E02F 9/226; E02F 3/46; E02F 3/47; E02F 3/58; E02F 9/2016; B66F 9/07595

See application file for complete search history.

(56) References Cited

U.S. PATENT DOCUMENTS

| | | | | |
|---|---|---|---|---|
| 1,408,263 | A * | 2/1922 | Brun | B66C 23/78 212/172 |
| 2,033,883 | A | 3/1936 | Davidson et al. | |
| 2,435,740 | A | 2/1948 | Edward | |
| 2,529,200 | A * | 11/1950 | Swanson | E02F 9/163 414/690 |
| 3,278,045 | A | 10/1966 | Potter et al. | |
| 4,050,586 | A | 9/1977 | Morrow, Sr. et al. | |
| 4,081,081 | A | 3/1978 | Morrow, Sr. et al. | |
| 4,363,412 | A | 12/1982 | Patel et al. | |
| 4,608,743 | A | 9/1986 | Stewart | |

(Continued)

FOREIGN PATENT DOCUMENTS

| | | |
|---|---|---|
| CN | 201560067 | 8/2010 |
| JP | 51156109 | 12/1976 |

(Continued)

*Primary Examiner* — Gerald McClain

(57) ABSTRACT

A power shovel including a tool for lifting, a machine house, a hoist drum, hoist drum machinery and an auxiliary weight box having a perimeter, the hoist drum and hoist drum machinery being at least partially disposed within the perimeter of the auxiliary weight box and the hoist drum being disposed outside of the machine house.

7 Claims, 6 Drawing Sheets

(56) References Cited

U.S. PATENT DOCUMENTS

| | | | | |
|---|---|---|---|---|
| 4,635,803 | A * | 1/1987 | Foster | B66C 23/52 212/239 |
| 5,598,935 | A * | 2/1997 | Harrison | B66C 23/74 180/69.1 |
| 8,827,091 | B2 * | 9/2014 | Yokoyama | B66C 23/62 212/181 |
| 2003/0156937 | A1 | 8/2003 | Brown et al. | |
| 2013/0259621 | A1 * | 10/2013 | Wurster | E02F 3/46 414/685 |
| 2014/0219762 | A1 * | 8/2014 | Bienfang | E02F 3/46 414/685 |

FOREIGN PATENT DOCUMENTS

| | | |
|---|---|---|
| JP | 07101677 | 4/1995 |
| JP | 10102542 | 4/1998 |
| JP | 2000064352 | 2/2000 |
| JP | 2006056621 | 3/2006 |
| JP | 2006057373 | 3/2006 |

* cited by examiner

POWER SHOVEL HOIST MACHINERY WITH AUXILIARY WEIGHT BOX

RELATED APPLICATIONS

This application is a divisional of U.S. application Ser. No. 13/757,059, by Frank R. Szpek Jr. et al., filed Feb. 1, 2013.

TECHNICAL FIELD

The present disclosure is directed to a power shovel having hoist machinery and, more particularly, to a hoist machinery and ballast configuration for a power shovel.

BACKGROUND

This section is intended to provide a background or context to the invention recited in the claims. The description herein may include concepts that could not be pursued, but are not necessarily ones that have been previously conceived or pursued. Therefore, unless otherwise indicated herein, what is described in this section is not prior art to the description and claims in this application and is not admitted to be prior art by inclusion in this section.

Power shovels are in a category of excavation equipment used to remove large amounts of overburden and ore during a mining operation. One type of power shovel is known as a rope shovel. A rope shovel includes a boom, a dipper handle pivotally connected to a mid-point of the boom, and a dipper (also known as a shovel) pivotally connected at one end of the dipper handle. A cable extends over a pulley at a distal end of the boom and terminates at the end of the dipper handle supporting the dipper. The cable is reeled in or spooled out on a hoist drum, the hoist drum being powered by electric, hydraulic, and/or mechanical motors to selectively raise and lower the dipper.

The power shovel may also include auxiliary weights. The auxiliary weights serve as ballast to offset the weight of ore that may be carried in the dipper. Adding additional auxiliary weights to the power shovel is desirable in that it may increase the amount of ore that can be carried by the dipper. However, adding additional auxiliary weights to the power shovel also makes the power shovel heavier which results in increased fuel usage and can inhibit the power shovel from entering areas where the ground is soft.

One example of a power shovel having auxiliary weights serve as ballast is U.S. Pat. No. 4,608,743 titled "MINING SHOVEL BALLAST BOX CONNECTION METHOD AND APPARATUS". The '743 Patent indicates that a large ballast box may be attached to the main rotating body of a power mining shovel. The '743 Patent further describes that the ballast box may weigh several hundred thousand pounds and serves as a counterweight to all of the forces generated on a forward end of the power mining shovel.

SUMMARY

In one embodiment the disclosure includes a power shovel having a body and an auxiliary weight box coupled to the body, the auxiliary weight box having a perimeter. The power shovel further includes an auxiliary weight disposed in the auxiliary weight box and a hoist drum disposed above the auxiliary weight box, the hoist drum being at least partially disposed within the perimeter of the auxiliary weight box.

In an alternative embodiment the disclosure illustrates a power shovel having a body, a machine house coupled to the body, an electrical component disposed in an interior of the machine house, and a hoist drum coupled to the body, the hoist drum being disposed outside of the machine house. A cable is coupled to the hoist drum, the cable being disposed outside of the machine house, and a dipper is coupled to the cable, the dipper and cable being configured such that the dipper is raised or lowered when the hoist drum rotates.

In yet another embodiment the disclosure is a machine having a body, a machine house coupled to the body, an auxiliary weight box coupled to the body, the auxiliary weight box having a perimeter, and an auxiliary weight disposed in the auxiliary weight box. The machine also includes a hoist drum disposed above the auxiliary weight box, the hoist drum being at least partially disposed within the perimeter of the auxiliary weight box, an electrical component disposed in an interior of the machine house, a cable coupled to the hoist drum, the cable being disposed outside of the machine house, and a dipper coupled to the cable, the dipper and cable being configured such that the dipper is raised or lowered when the hoist drum rotates.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
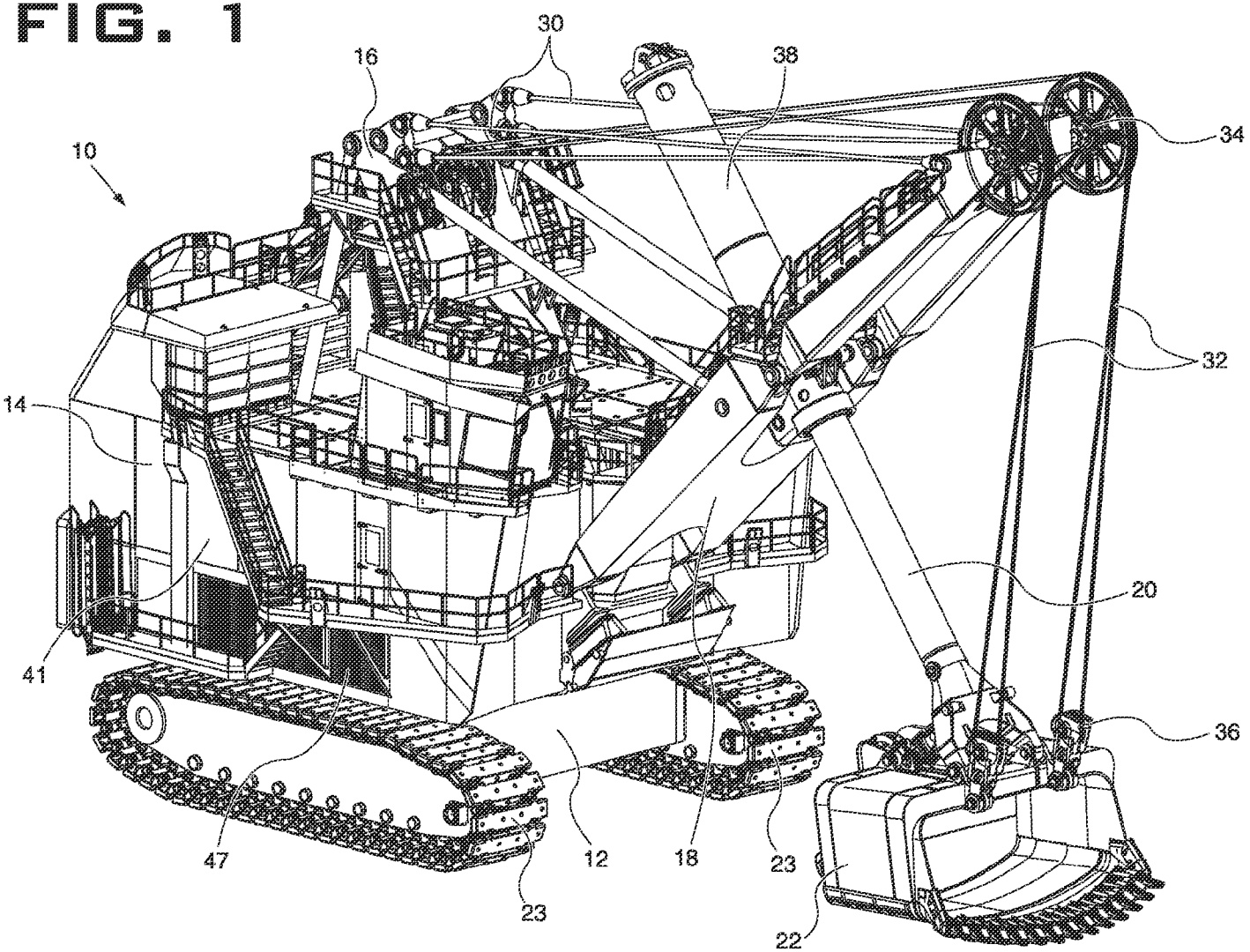
FIG. 1 is a perspective view of a rope shovel, according to an exemplary embodiment.

FIG. 1 illustrates an exemplary embodiment of a machine 10. Machine 10 may perform some type of operation associated with an industry such as mining, construction, or any other industry known in the art. For example, machine 10 may embody an earth moving machine such as the power shovel depicted in FIG. 1. Machine 10 may include a base 12, a body 14 operatively connected to base 12, a gantry member 16 rigidly mounted to a top side of body 14 opposite base 12, a boom 18 pivotally connected to a leading end of body 14, a dipper handle 20 pivotally connected to a midpoint of boom 18, a tool 22 pivotally connected to a distal end of dipper handle 20, and cabling connecting gantry member 16, boom 18, dipper handle 20, and tool 22.

Base 12 may be a structural unit that supports movements of machine 10. In the disclosed exemplary application, base 12 is itself movable, having one or more traction devices such as feet, tracks 23 (shown in FIG. 1), and/or wheels that are driven to propel machine 10 over a work surface. In other applications, however, base 12 may be a stationary platform configured for direct engagement with work surface.

Body 14 may pivot relative to base 12. Specifically, body 14 may pivot relative to base 12 about a substantially vertical axis. As body 14 is pivoted about the vertical axis, attached gantry member 16, boom 18, dipper handle 20, and tool 22 may likewise pivot to change a radial engagement angle of tool 22 with the work surface.

Gantry member 16 may be a structural frame member, for example a general A-frame member that is configured to anchor one or more cables 30 to body 14. Gantry member 16 may be extend from body 14 in a vertical direction away from base 12. Gantry member 16 may be located rearward of boom 18 relative to tool 22 and, in the disclosed exemplary embodiment, fixed in a single orientation and position. Cables 30 may extend from an apex of gantry member 16 to a distal end of boom 18, thereby transferring a weight of boom 18, tool 22, and a load contained by tool 22 into body 14.

Figure 2:
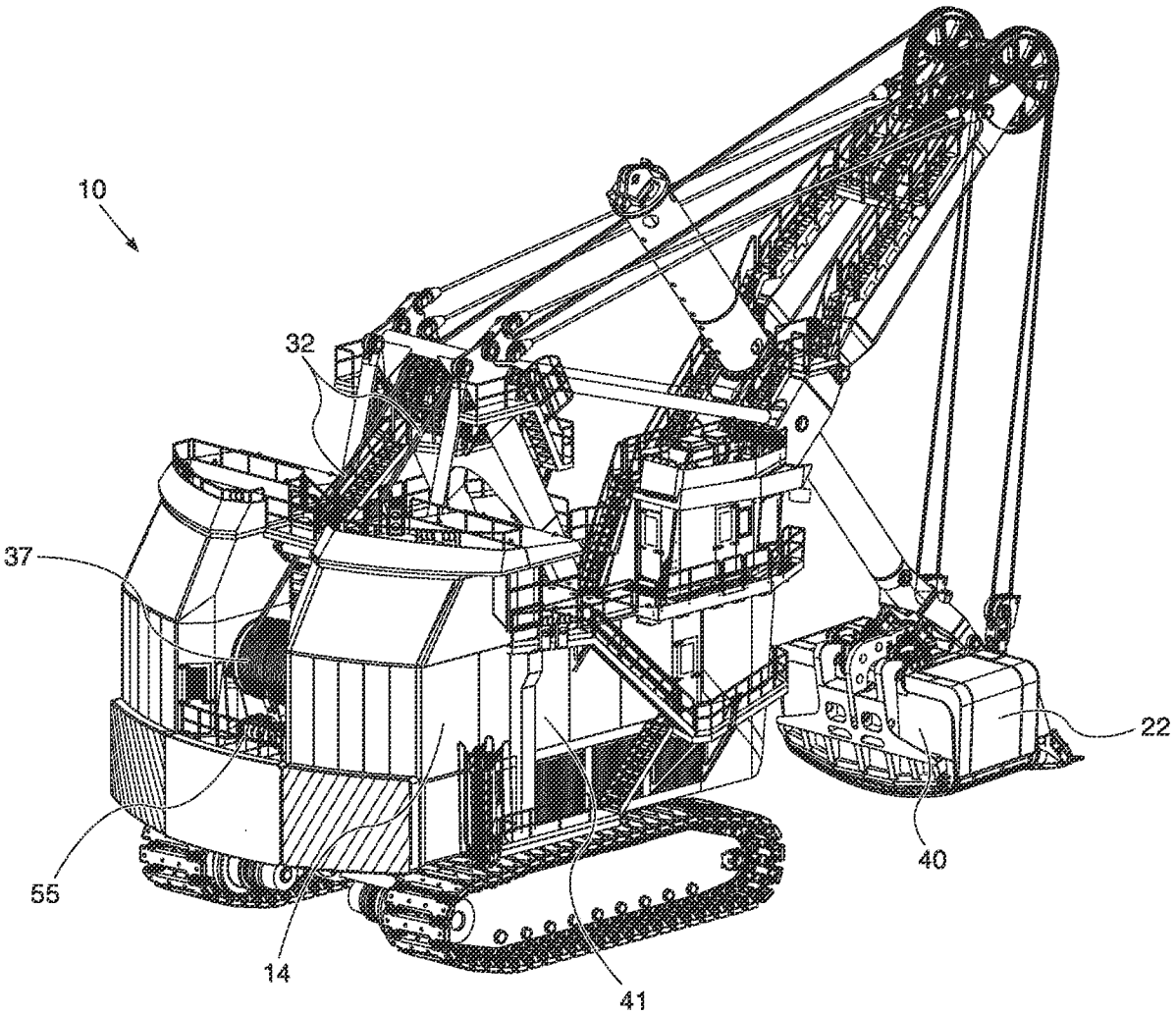
FIG. 2 is another perspective view of the rope shovel of FIG. 1.
Figure 3:
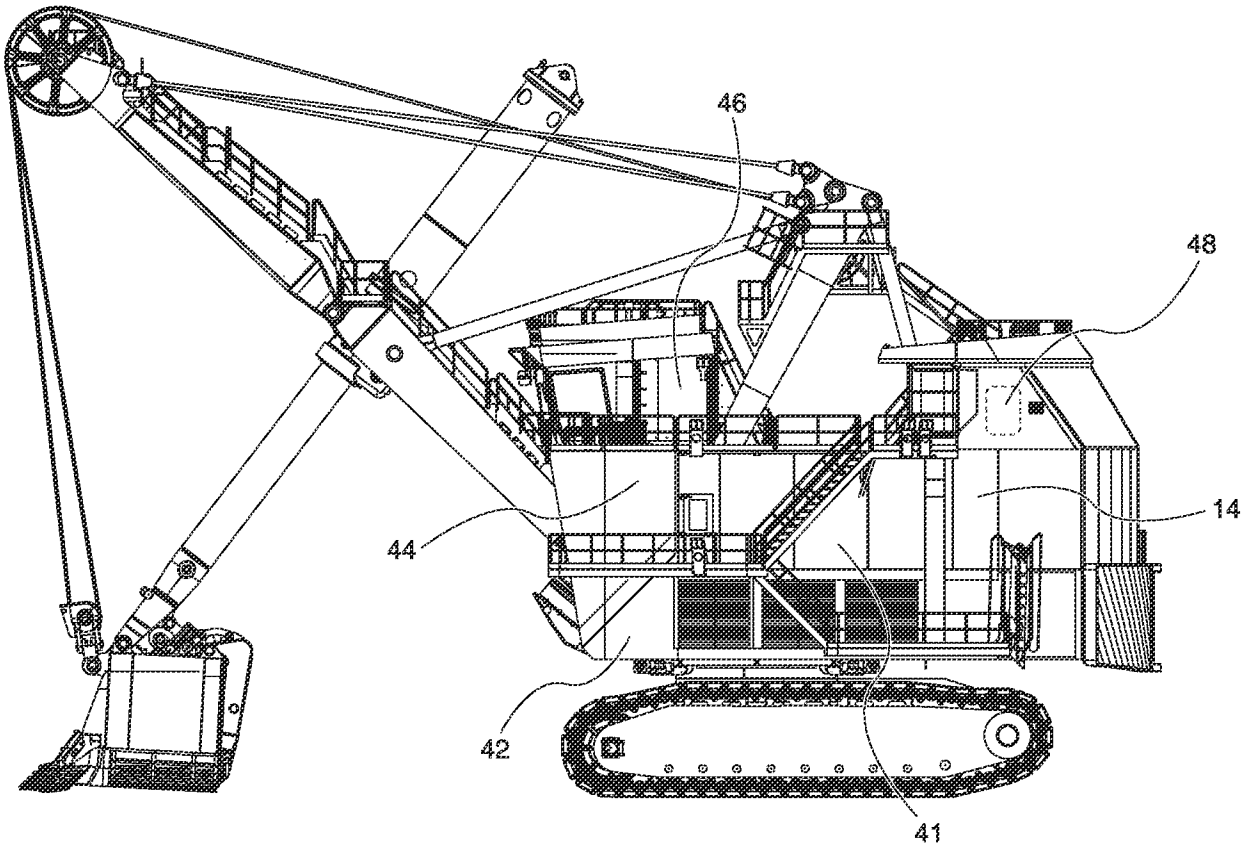
FIG. 3 is a side view of the rope shovel of FIG. 1.
Figure 4:
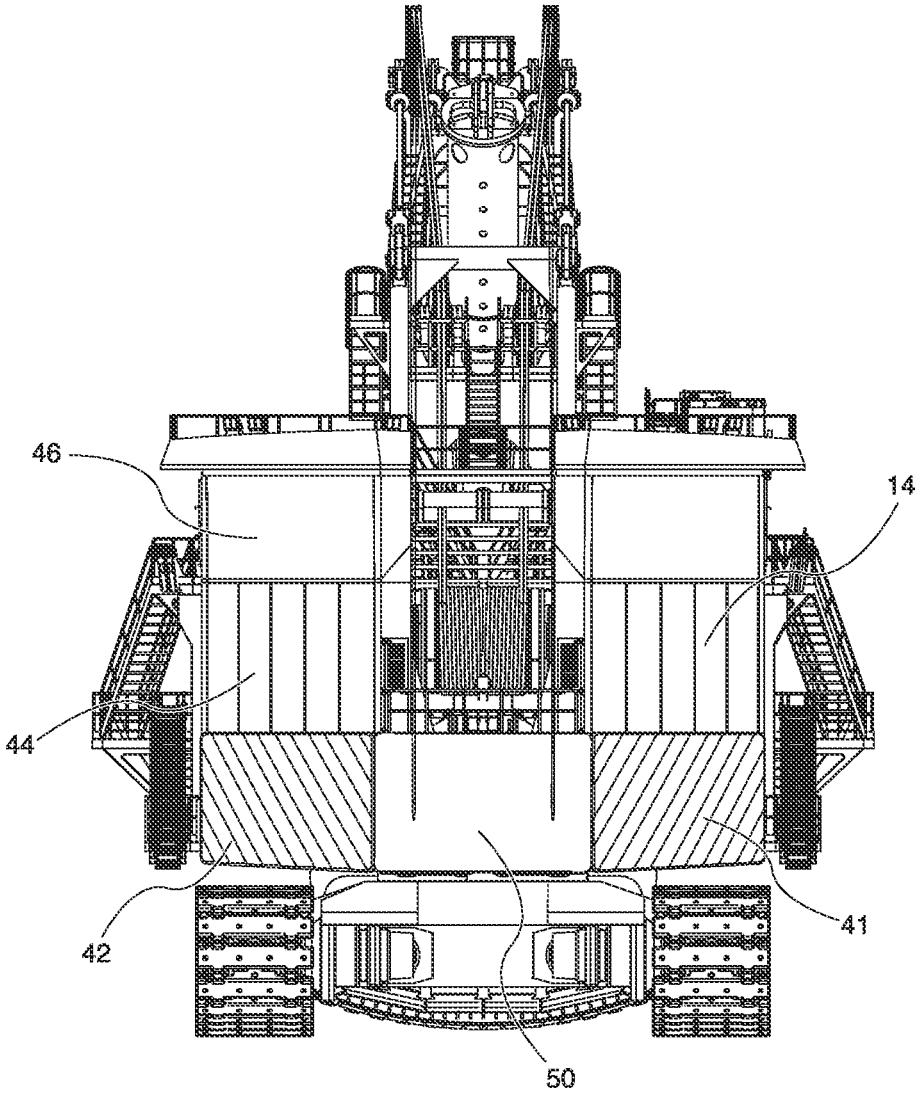
FIG. 4 is a rear view of the rope shovel of FIG. 1.

Boom 18 may be pivotally connected at a base end to body 14, and constrained at a desired vertical angle relative to work surface by cables 30 (also known as suspension cables). Additional cables 32 (also known as hoist cables) may extend from body 14 over a pulley mechanism 34 located at the distal end of boom 18 and around a pulley mechanism 36 of tool 22. Cables 32 may connect tool 22 to body 14 by way of a hoist drum 37 (best seen in FIG. 2). The hoist drum 37 may be powered by hoist drum machinery 39, such that a rotation of the hoist drum machinery 39 rotates the hoist drum 37. The hoist drum machinery 39 may include at least one of a motor, an engine, a pump and a transmission. As the hoist drum 37 rotates it reels in or spools out cables 32. The reeling in and spooling out of cables 32 may affect the height and angle of tool 22 relative to work surface. For example, when cables 32 are reeled in, the decreasing effective length of cables 32 may cause tool 22 to rise and tilt backward away from work surface. In contrast, when cables 32 are spooled out, the increasing effective length of cables 32 may cause tool 22 to lower and tilt forward toward work surface. Cables 30 and cables 32 may also be referred to as ropes.

Dipper handle 20 may be pivotally connected at one end to a general midpoint of boom 18. In this position, dipper handle 20 may function to maintain a desired distance of tool 22 away from boom 18 and ensure that tool 22 moves through a desired arc as cables 32 are reeled in and spooled out. In the disclosed embodiment, dipper handle 20 may be connected to boom 18 at a location closer to the base end of boom 18, although other configurations are also possible. Dipper handle 20 may be provided with a crowd cylinder 38 that functions to extend or retract dipper handle 20. In this manner, the distance between tool 22 and boom 18 (as well as the arcuate trajectory of tool 22) may be adjusted.

Tool 22, in the disclosed embodiment, is known as a dipper. A dipper is a type of shovel bucket having a pivotal door 40 located at a back side opposite a front side excavation opening. Door 40 may be hinged, so that it can be selectively opened and closed by the operator of machine 10 during an excavating operation.

The body 14 may include a machine house 41 or in some embodiments the machine house 41 is coupled to the body 14. In the illustrated embodiment the machine house 41 includes a first, second and third level 42, 44, 46, each level having a height to allow an average-sized person to stand entirely in the level. The machine house 41 is pressurized such that one or more fans 48 blow air into the machine house 41 to raise the pressure inside the machine house 41 so that it is higher than atmospheric pressure.

The first level 42 is disposed proximate to the base 12. At least two radiators 47 are disposed on the first level 42, the at least two radiators 47 serving to assist in cooling a mechanical or electrical component. An auxiliary weight box 50 is also disposed in the first level 42. The first level 42 may also house other components such as electrical gear 49, motors 51, pumps, etc.

Figure 5:
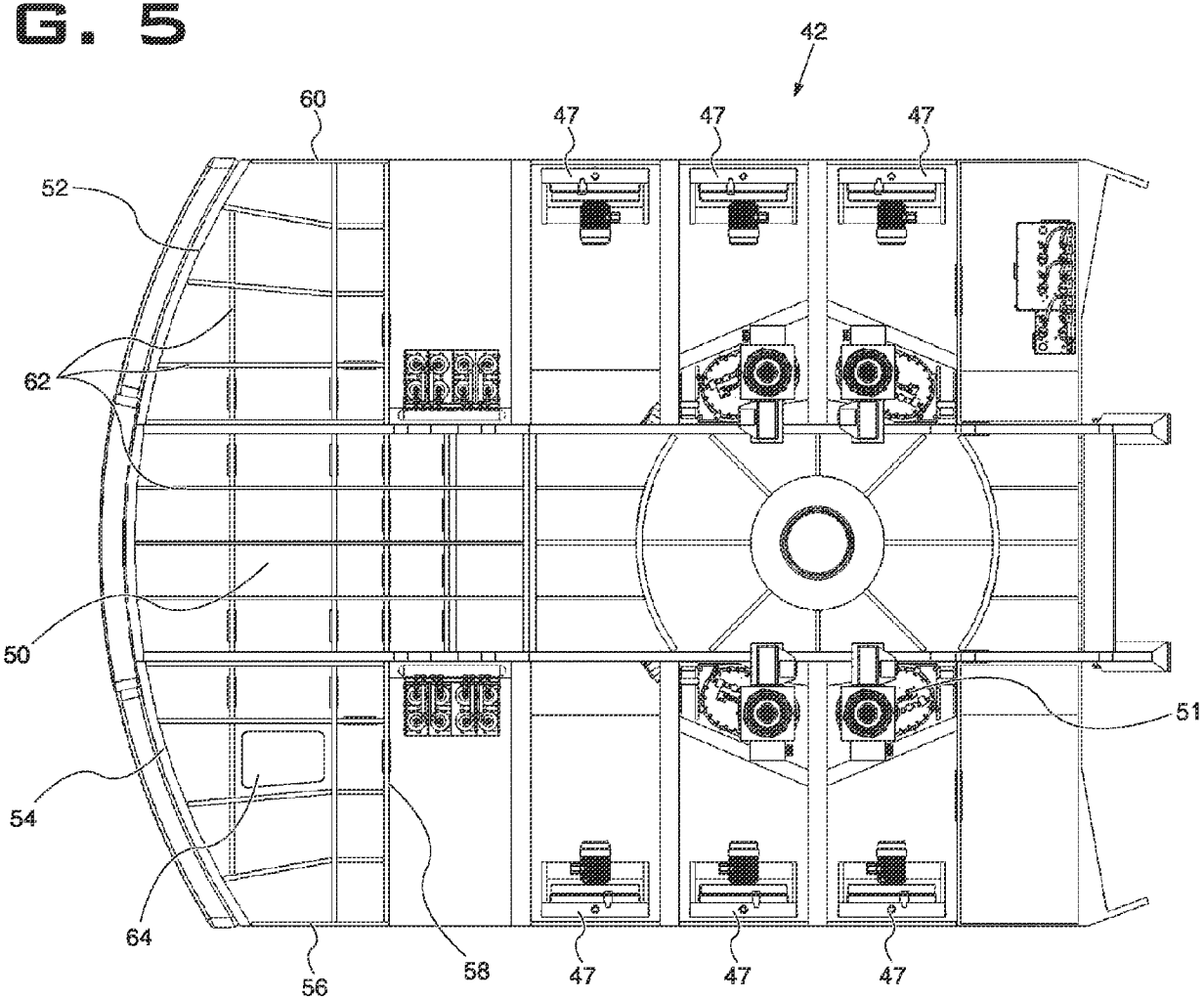
FIG. 5 is a top view of a first level of the rope shovel of FIG. 1.
Figure 6:
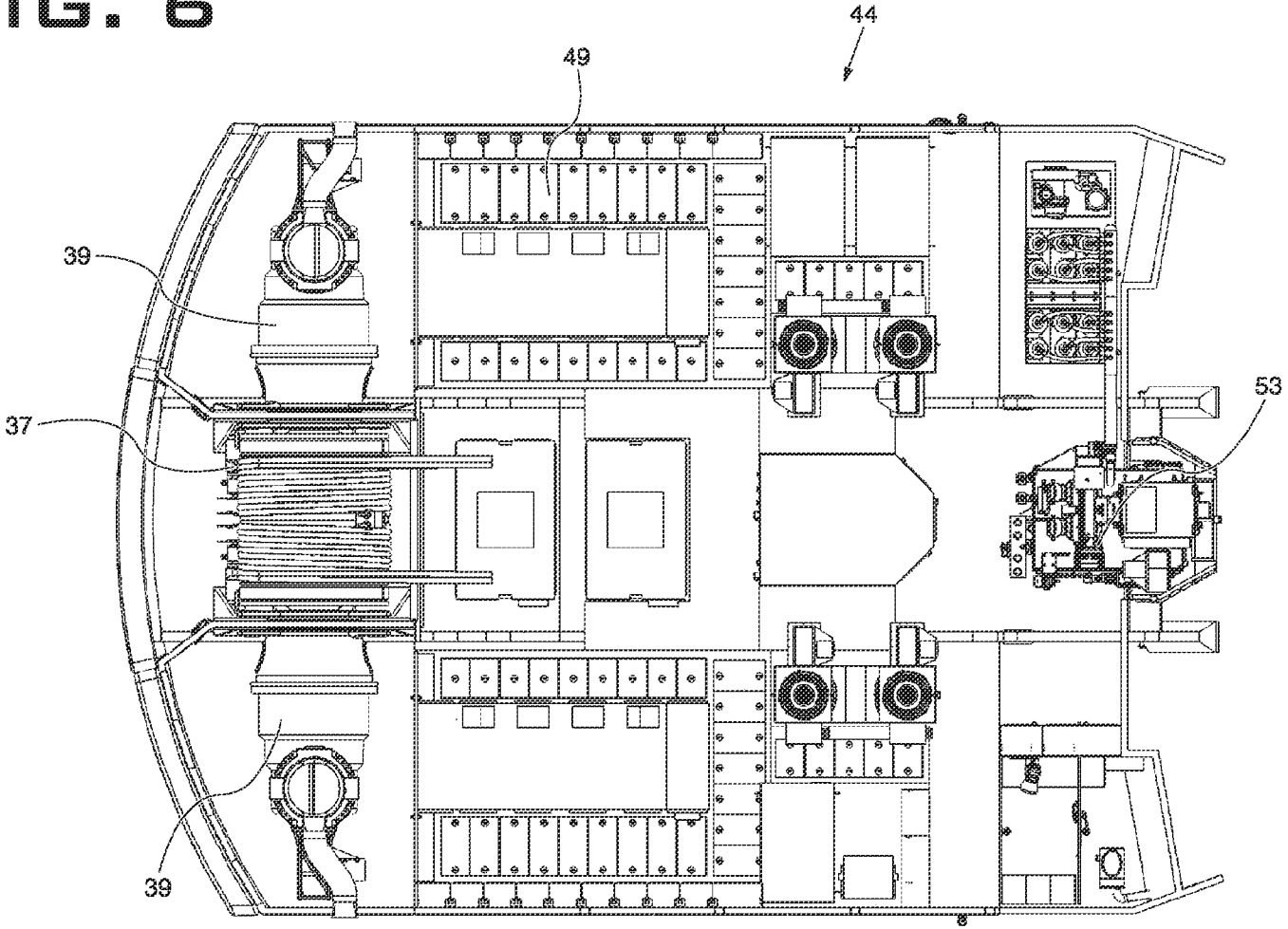
FIG. 6 is a top view of a second level of the rope shovel of FIG. 1.

The auxiliary weight box 50, best seen in FIG. 5, is coupled to the body 14, opposite from where the boom 18 is coupled to the body 14. In the illustrated embodiment the auxiliary weight box 50 is disposed inside of the machine house 41. In alternative embodiments the auxiliary weight box 50 may be integral to the body 14 and/or machine house 41. The auxiliary weight box 50 has a perimeter 52. The perimeter 52 includes a first side 54, second side 56, third side 58 and fourth side 60, the perimeter 52 defining an area of the auxiliary weight box 50. In the illustrated embodiment the auxiliary weight box 50 includes a plurality of partitions 62, the partitions 62 serving to inhibit auxiliary weights 64 from moving throughout the auxiliary weight box 50. One or more auxiliary weights 64 are placed inside of the auxiliary weight box 50. In some embodiments metal plates are used as auxiliary weights 64, while in other embodiments sand, rock, dirt or the like is used as auxiliary weights 64. In the illustrated embodiment the auxiliary weight box 50 is disposed on the first level 42. In an alternative embodiment the auxiliary weight box 50 may be disposed on the second level 44 or third level 46.

The second level 44 is disposed proximate to the first level 42, and is directly above the first level 42. In the illustrated embodiment the machine house 41 is disposed on part of the second level 44, while part of the second level 44 is open to the atmosphere. Electrical gear 49 and hydraulic pumps 53 are disposed on the second level 44 inside of the machine house 41. The hoist drum 37 is disposed on the second level 44, the hoist drum 37 being coupled to an exterior surface 55 of the machine house 41. In the illustrated embodiment the hoist drum 37 is disposed directly above the auxiliary weight box 50 and is entirely within the perimeter 52 of the auxiliary weight box 50. In an alternative embodiment only a portion of the hoist drum 37 is disposed within the perimeter 52 of the auxiliary weight box 50. In yet another alternative embodiment the hoist drum 37 is disposed on a different level, but is still partially within the perimeter 52 of the auxiliary weight box 50. The hoist drum machinery 39 is disposed on the second level 44, proximate to the hoist drum 37. In the illustrated embodiment the hoist drum machinery 39 is inside of the machine house 41, the hoist drum machinery 39 being coupled to the hoist drum 37 through an opening in the machine house 41. The hoist drum machinery 39 is entirely within the perimeter 52 of the auxiliary weight box 50. In an alternative embodiment, the hoist drum machinery 39 is only partially within the perimeter 52 of the auxiliary weight box 50.

The third level 46 is disposed proximate to the second level 44 and is directly above the second level 44. The fans 48 are inside of the machine house 41 on the third level 46. In addition, an operator's station 60 is disposed on the third level 46, the operator's station 60 housing one or more interfaces used to operate the machine 10.

INDUSTRIAL APPLICABILITY

The configuration for the machine 10 described herein may be implemented into any industrial vehicle having a hoist drum 37 and a tool 22 used for lifting. The disclosed configuration allows the tool 22 to lift a greater load without making the machine 10 heavier in part because the hoist drum 37 and hoist drum machinery 39 serve as ballast to counteract the weight of a material being lifted by the tool 22. When the tool 22 is lifting a load the cable 32 coupled to the tool 22 and the hoist drum 37 transmits a pulling force on the hoist drum 37, the pulling force being in an upward direction (away from the base 12). The pulling force on the hoist drum 37 in the upward direction at least partially counteracts the downward force of the auxiliary weight 64, hoist drum 37 and hoist drum machinery 39.

The disclosed configuration allows the machine house 41 to be substantially sealed or allows the machine to be operated without having any large openings in the machine house 41, which requires fewer fans 48 to pressurize the machine house 41, resulting in less energy being used to maintain a positive pressure in the machine house 41. In addition, having few or no large openings in the machine house 41 assists in keeping the interior of the machine house 41 cleaner, for example by inhibiting the entry of airborne dust or dirt particles into the machine house 41, which can prolong the life of various components housed therein.

It will be apparent to those skilled in the art that various modifications can be made to the disclosed machine. Other embodiments will be apparent to those skilled in the art from consideration of the specification and practice of the disclosed machine. It is intended that the specification and examples be considered as exemplary only, with a true scope being indicated by the following claims and their equivalents.

What is claimed is:

1. A power shovel comprising:

a body;

a machine house coupled to the body, the machine house comprising a first level and a second level with the second level being disposed directly above the first level;

an electrical component disposed in an interior of the machine house;

at least two radiators are disposed on the first level;

a powered hoist drum coupled to the body, the hoist drum being disposed on the second level and outside of the machine house;

a cable coupled to the hoist drum, the cable being disposed outside of the machine house;

a dipper coupled to the cable, the dipper and cable being configured such that the dipper is raised or lowered when the hoist drum rotates; and at least two hoist drum motors disposed inside of the machine house and coaxial with a hoist drum axis.

2. The power shovel of claim 1 further comprising at least one fan configured to pressurize the machine house to inhibit dust or other airborne particles from entering the machine house.

3. The power shovel of claim 1 further comprising a hoist drum machinery coupled to the hoist drum, the hoist drum machinery being configured to rotate the hoist drum and wherein the hoist drum machinery is disposed in the interior of the machine house.

4. The power shovel of claim 1 further comprising a hydraulic pump disposed in the interior of the machine house.

5. The power shovel of claim 4 further comprising an auxiliary weight box disposed in an interior of the machine house.

6. The power shovel of claim 5, wherein an upward force from the cable coupled to the hoist drum at least partially counteracts a downward force from the auxiliary weight box.

7. The power shovel of claim 5, wherein the auxiliary weight box has a perimeter defining a horizontal cross-sectional area of the auxiliary weight box, and the power shovel comprises an auxiliary weight disposed in the auxiliary weight box.

* * * * *